US006650302B2

(12) United States Patent
Sanad

(10) Patent No.: US 6,650,302 B2
(45) Date of Patent: Nov. 18, 2003

(54) ULTRA-WIDEBAND MONOPOLE LARGE-CURRENT RADIATOR

(75) Inventor: Mohamed Said Sanad, Reno, NV (US)

(73) Assignee: Aether Wire & Location, Nicasio, CA (US)

( * ) Notice: Subject to any disclaimer, the term of this patent is extended or adjusted under 35 U.S.C. 154(b) by 0 days.

(21) Appl. No.: 10/186,799

(22) Filed: Jul. 1, 2002

(65) Prior Publication Data

US 2003/0011525 A1 Jan. 16, 2003

Related U.S. Application Data

(60) Provisional application No. 60/305,398, filed on Jul. 13, 2001.

(51) Int. Cl.[7] ..... H01Q 1/52; H01Q 1/48
(52) U.S. Cl. ..... 343/841; 343/846
(58) Field of Search ..... 343/841, 845, 343/846, 847, 848

(56) References Cited

U.S. PATENT DOCUMENTS 5,801,660 A * 9/1998 Ohtsuka et al. ..... 343/700 MS
6,246,371 B1 * 6/2001 Kurz et al. ..... 343/702
6,317,083 B1 * 11/2001 Johnson et al. ..... 343/700 MS
6,317,089 B1 * 11/2001 Wilson et al. ..... 343/713

* cited by examiner

*Primary Examiner*—Don Wong
*Assistant Examiner*—Minh D A
(74) *Attorney, Agent, or Firm*—Integral Patent Associates; Laurence J. Shaw

(57) ABSTRACT

An ultra-wideband, large-current radiator consisting of a ground plane and two electric monopoles: a wide radiating monopole orthogonal to the ground plane, and a thin monopole orthogonal to the ground plane and normally displaced from the wide monopole. The frequency-independent low impedance of the antenna allows a small voltage to generate a large current. The wide radiating monopole may be a flat sheet, or a sheet of parallel bars. Shielding by the wide monopole suppresses radiation from the thin monopole into a sector of space into which the monopole radiation characteristic of a well-formed impulse in response to a voltage step is desired. In one preferred embodiment, two parallel flat sheets or a conducting cylinder is used as the wide radiating monopole, further shielding radiation from the thin monopole.

29 Claims, 12 Drawing Sheets

$\Phi$=45°, $\Theta$=45°

$\Phi$=45°, $\Theta$=90°

$\Phi$=0°, $\Theta$=45°

$\Phi$=0°, $\Theta$=90°

$\Phi$=45°, $\Theta$=45°

$\Phi$=45°, $\Theta$=90°

$\Phi$=0°, $\Theta$=45°

$\Phi$=0°, $\Theta$=90°

$\Phi$=45°, $\Theta$=45°

$\Phi$=45°, $\Theta$=90°

$\Phi$=0°, $\Theta$=45°

$\Phi$=0°, $\Theta$=90°

ULTRA-WIDEBAND MONOPOLE LARGE-CURRENT RADIATOR

CROSS REFERENCE TO RELATED APPLICATIONS

The present application is based on provisional patent application serial No. 60/305,398, filed Jul. 13, 2001, by the same inventor and having the same title.

FIELD OF THE INVENTION

The present invention relates generally to antennas, and more particularly to ultra-wideband antennas. The present invention also relates generally to antennas which incorporate a ground plane, to monopole antennas, and to antennas driven with an unbalanced power source.

BACKGROUND OF THE INVENTION

A typical radio-communications antenna, such as an AM, FM or television antenna, is designed to operate efficiently for reception and/or transmission over a range of frequencies which is small relative to the central frequency of the range. Much theoretical and empirical research has been devoted to the design of such antennas. Less common are wideband antennas where the range of frequencies over which the antenna operates is not small in relation to the central frequency transmitted. Non-sinusoidal spread-spectrum radio communications (i.e., communications where pulse sequences are transceived) require ultra-wideband antennas since the frequency components of a pulse with time width $\delta t$ extend all the way from zero frequency to frequencies on the order of $1/\delta t$. Therefore, the transmission of a 1 nanosecond pulse requires an antenna with a frequency response that extends all the way from 0 Hz to around 1 GHz.

Ultra-wideband antennas are difficult to design because numerous approximations used in the design of standard antennas do not hold, particularly if the frequency range must extend into the gigahertz. For instance, skin-depth effects become important, emissions from various portions of the antenna interact with current flows in other portions of the antenna, the velocity of current flow within the antenna must explicitly be taken into account, etc.

A dipole large-current radiator (DLCR) as taught by the prior art is shown in FIG. 1. (See Henning Harmuth and Shao Ding-Rong, "Antennas for Nonsinusoidal Waves. I. Radiators," IEEE Transactions on Electromagnetic Compatibility, Vol. EMC-25, No. 1, February 1983.) The DLCR (100) consists of a main radiator (105), side leads (117*a*) and (117*b*), rear leads (120*a*) and (120*b*), power leads (121*a*) and (121*b*), and a power source (140). Side lead (117*a*) is attached to the horizontally-oriented, main radiator (105) at a first end (106*a*) and extends downwards therefrom, and consists of an upper, flared section (115*a*) and a lower, thin section (116*a*). (Terms such as "horizontal," "vertical," "left," "right," "above," and "below" are used in the claims and in the descriptions of the antennas in the present specification in reference to the accompanying figures for ease of explanation to describe relative positions, and are not intended to imply that the antennas can only be oriented in the directions shown in the figures.) Similarly, side lead (117*b*) is attached to the main radiator (105) at the other end (106*b*) and extends downwards therefrom, and consists of an upper, flared section (115*b*) and a lower, thin section (116*b*). The lower ends of the side leads (117*a*) and (117*b*) are connected to rear leads (120*a*) and (120*b*) which extend therefrom in the −x and +x directions, respectively. The inside ends of the rear leads (120*a*) and (120*b*) connect to power supply leads (121*a*) and (121*b*), respectively, which extend vertically downwards.

The power supply leads (121) are connected to a balanced power supply (140), i.e., a power supply where the voltage at one terminal is of equal magnitude but opposite polarity from the voltage at the other terminal. (In the present specification, a reference numeral which has a three-digit number section and is not appended by a letter will be used to refer generically to pairs of elements whose references numerals have the same three-digit number section and end with a letter.) The DLCR (100) of FIG. 1 is thus considered a "dipole" antenna because it is symmetric about the dividing line (104) at the mid-point of the current flow, and centrally powered by a balanced current source, so the current in the antenna (100) is symmetric about the dividing line (104). For instance, as a current propagates from the first edge (106*a*) to the middle of the main radiator (105), a current of the same magnitude and in the same direction will propagate from the main radiator (105) into the opposite edge (106*b*). Similarly, the rear leads (120) form a second radiating dipole. To some extent—the extent being determined by the degree to which the currents in the rear leads (120) and the main radiator (105) are out of phase—the combination of the main radiator (105) and the rear leads (120) will function as a quadrupole radiator, and thus have limited efficiency over much of the solid angle around the DLCR (100). However, because much of the radiation emitted upwards from the rear leads (120) is blocked (or 'shielded') by the main radiator (105), in the +z direction the DLCR (100) will function more like a dipole radiator. (Because the side leads (117) are parallel, have the same size and shape, and are powered by the balanced, low-impedance power source (140), signals radiated from them (117) will tend to have equal magnitude but opposite polarities, and will substantially cancel. More particularly, radiation from the side leads (117) will fall off with distance r faster than $1/r^2$.) The DLCR (100) is considered a "large-current" antenna because it is a low-impedance closed circuit spanning the output of the power supply (140). Since the far-field emissions about a conductor is proportional to the first time-derivative of the current distribution, the advantage of a large-current antenna is that large current changes, and therefore large emissions, can be produced.

Harmuth also teaches putting a wide radiation shield (not shown) directly under the main radiator (105), i.e., between the main radiator (105) and the rear leads (120), to absorb radiation from the rear leads (120). This allows the antenna (100) to function as a dipole radiator over a much wider range of solid angle. Although the above-referenced paper by Harmuth calculates the transmission characteristics of this antenna (100), construction of such an antenna (100) is problematic since: radiation shields, such as ferrite absorbers, generally do not have a permeability exceeding 10 gauss/oersted at frequencies of gigahertz; and if an absorber with a permeability on the order of 1000 gauss/oersted could be constructed, it would be bulky, weighty and expensive.

A further limitation of the DLCR (100) of FIG. 1 is that it cannot be used in applications where the equipment must have a ground plane in the vicinity, because of the substantial distortions caused by the radiation generated by image currents. Printed circuit boards have a ground plane, and, generally, portable, battery-powered transceivers use circuit-board circuitry and an unbalanced power source with one terminal connected to the ground plane. Although an ultra-wideband balun might be used to transform the unbalanced antenna signal to a balanced antenna signal, baluns are large and expensive.

Therefore, it is an object of the present invention to provide an ultra-wideband antenna, i.e., an antenna which can efficiently and accurately transceive pulses, particularly pulses on the order of 1 ns in length.

It is another object of the present invention to provide a large-current antenna, i.e., closed-loop, low-impedance antenna.

More particularly, it is an object of the present invention to provide a large-current and/or ultra-wideband antenna that performs well over a wide range of solid angle.

It is another object of the present invention to provide a large-current and/or ultra-wideband antenna that operates without use of an absorber.

It is another object of the present invention to provide a large-current and/or ultra-wideband antenna which incorporates a current-imaging conductor, such as a finite-size ground plane.

It is another object of the present invention to provide a large-current and/or ultra-wideband antenna which is powered by an unbalanced current source.

Additional objects and advantages of the invention will be set forth in the description which follows, and will be apparent from the description or may be learned from the practice of the invention. The objects and advantages of the invention may be realized and obtained by means of the instrumentalities and combinations particularly pointed out in the claims.

BRIEF DESCRIPTION OF THE DRAWINGS

The accompanying figures, which are incorporated in and form a part of this specification, illustrate embodiments of the invention and, together with the description given above and the detailed description of the preferred embodiments given below, serve to explain the principles of the invention.

DETAILED DESCRIPTION OF THE PREFERRED EMBODIMENTS

Figure 6A:
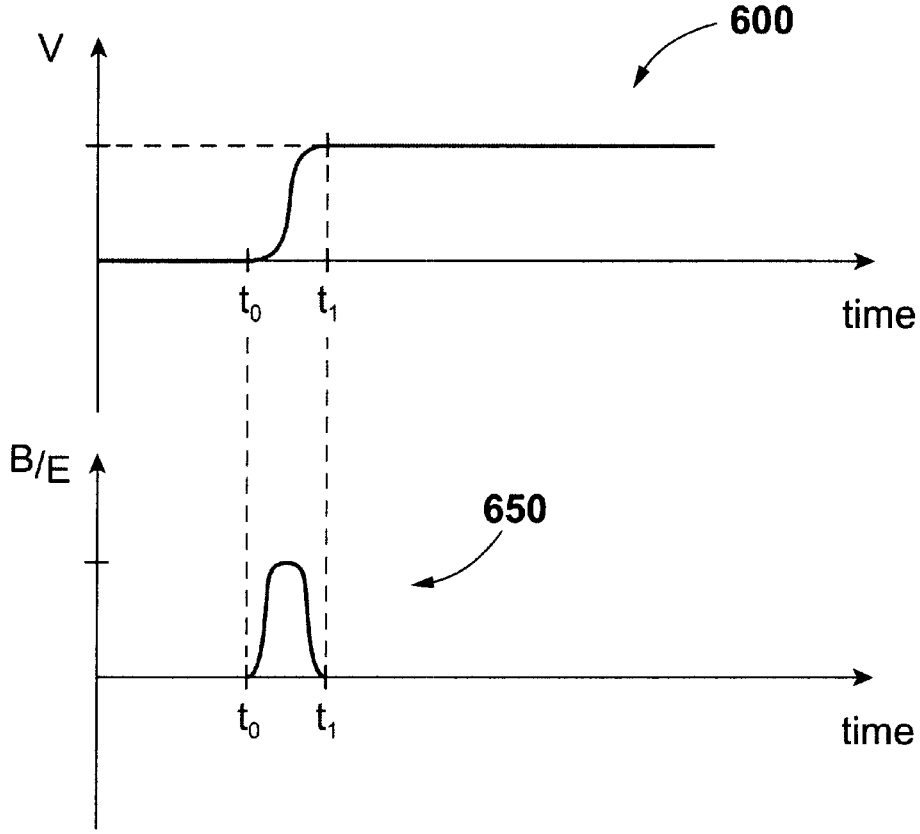
FIG. 6A shows the ideal relationship between an applied step-function voltage and a radiated signal.

As depicted in FIG. 6A, for the performance of an ultra-wideband antenna to be acceptable, a step-function input (600) must produce a single, well-formed radiation pulse (650). For portable transceivers, neither the $\Phi$ component nor the $\Theta$ component of the radiated electric field E (and, therefore, also the magnetic field) in each direction can have 'ringing.' This is necessary for portable transceivers because their orientation may change with time, so any polarization of the electric field E radiated in any direction might be important at any instant. (Furthermore, reflections can produce rotations of the polarization, although reflected radiation is generally much weaker than direct radiation.)

Figure 1:
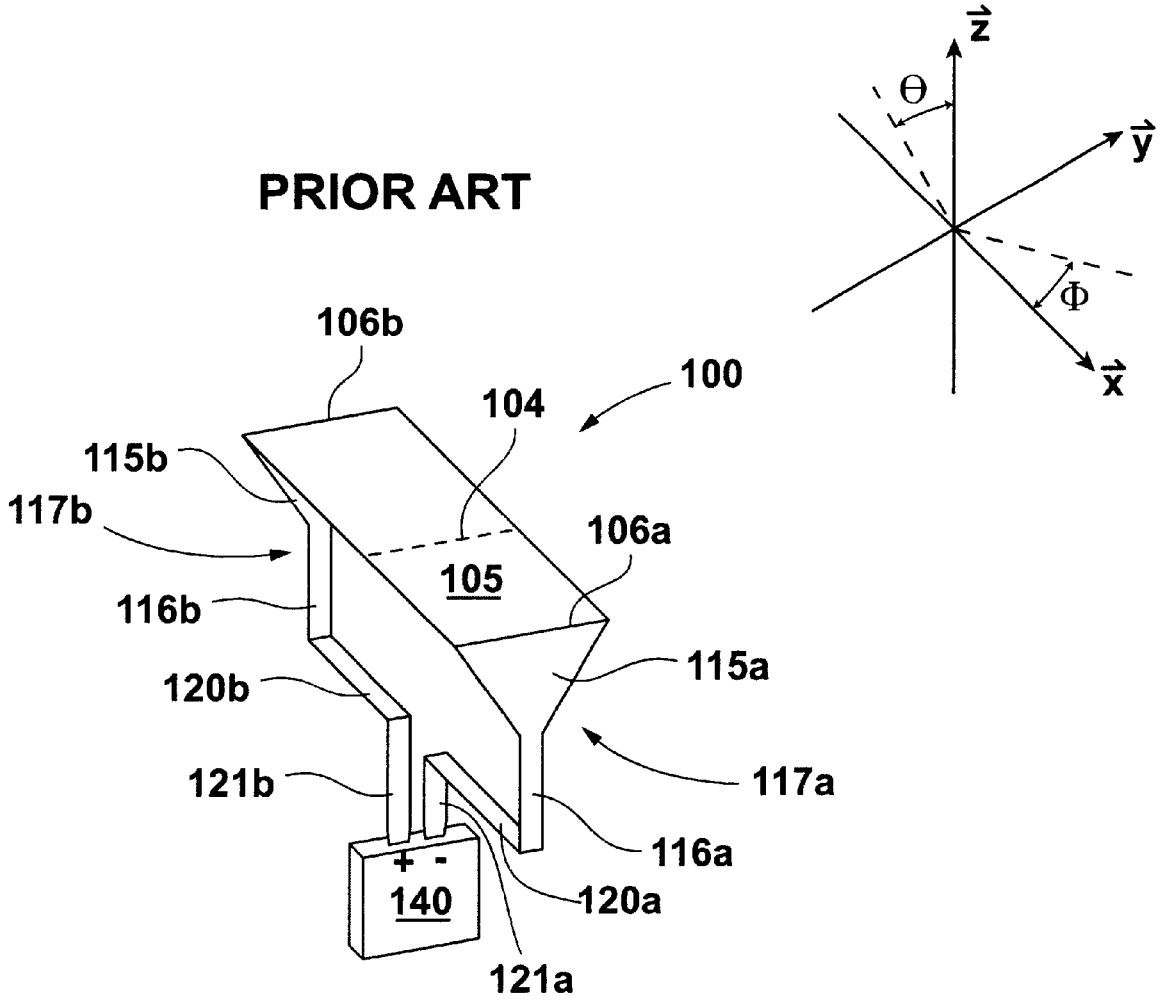
FIG. 1 shows a dipole large-current radiator according to the prior art.
Figure 2:
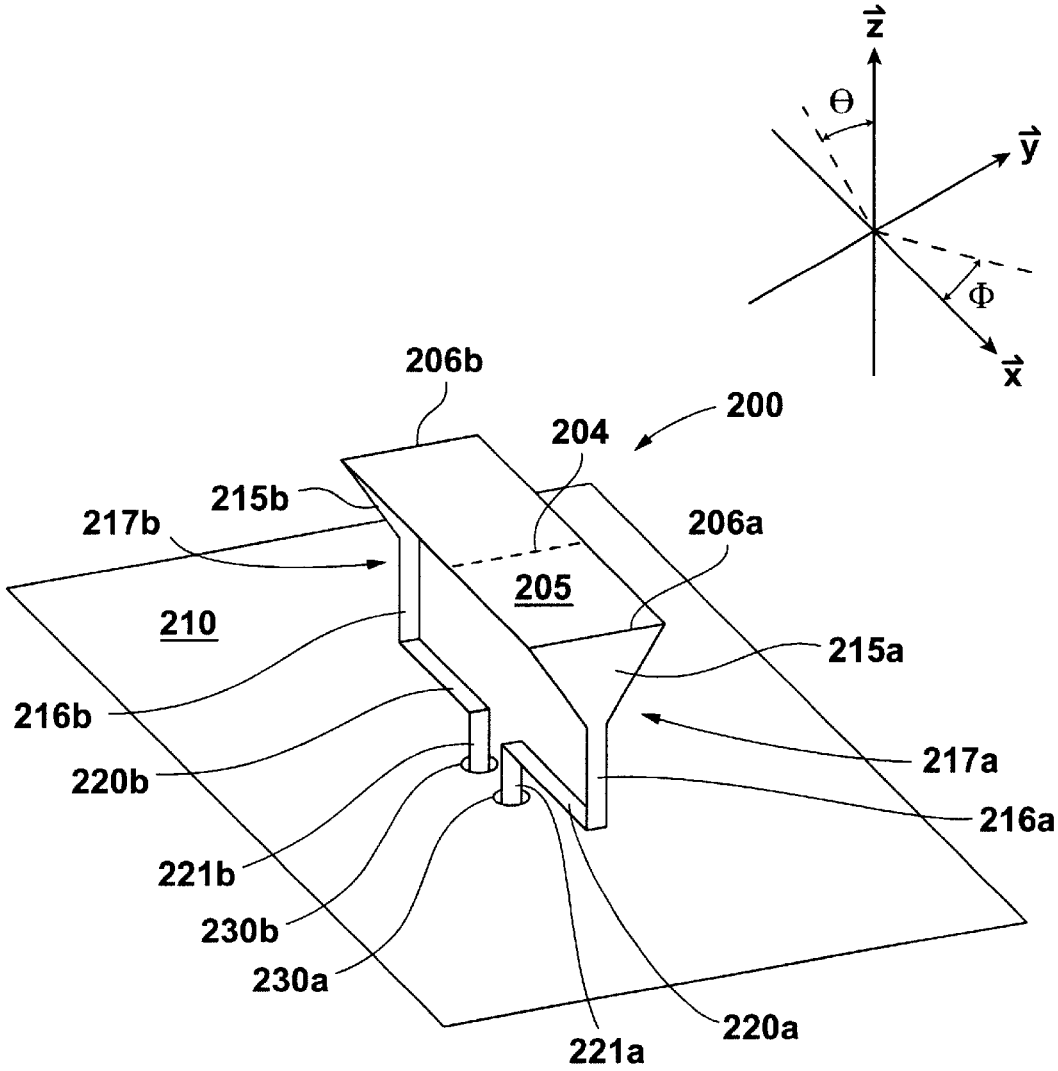
FIG. 2 shows a dipole large-current radiator which includes a ground plane.

Although it is not an optimal preferred embodiment, it is instructive to consider the effect of a ground plane on the DLCR (100) of FIG. 1. As shown in FIG. 2, such a DLCR (200) consists of a main radiator (205), side leads (217*a*) and (217*b*), rear leads (220*a*) and (220*b*), power leads (221*a*) and (221*b*), and a ground plane (210). Side lead (217*a*) is attached to the horizontally-oriented, main radiator (205) at a first end (206*a*) and extends downwards therefrom, and consists of an upper, flared section (215*a*) and a lower, thin section (216*a*). Similarly, side lead (217*b*) is attached to the main radiator (205) at the other end (206*b*) and extends downwards therefrom, and consists of an upper, flared section (215*b*) and a lower, thin section (216*b*). The lower ends of the side leads (217*a*) and (217*b*) are connected to rear leads (220*a*) and (220*b*) which extend therefrom horizontally in the −x and +x directions, respectively. The inside ends of the rear leads (120*a*) and (120*b*) connect to power supply leads (121*a*) and (121*b*) which extend vertically downwards through apertures (230*a*) and (230*b*), respectively, in the ground plane (210) to a balanced power supply (not shown). Electrically, the leads (221), (220), and (217), and the main radiator (205) are not connected to the ground plane (210).

The DCLR (200) of FIG. 2 is thus considered a "dipole" antenna because it is centrally powered by a balanced power source, so the current distribution in the DCLR (200) is symmetric about the dividing line (204) at its mid-point. The rear leads (220*a*) and (220*b*) are therefore also considered to form a second radiating dipole (220). Because the side leads (217) are parallel, have the same size and shape, and are symmetrically positioned in the loop powered by the balanced power source, signals radiated from them (217) (such as the signal caused by the electric field which produces the spreading of an upwards current as it proceeds from the apex to the base of a triangular section 115) will tend to have equal magnitude but opposite polarities, and will substantially cancel in the far-field as discussed above.

Figure 7A:
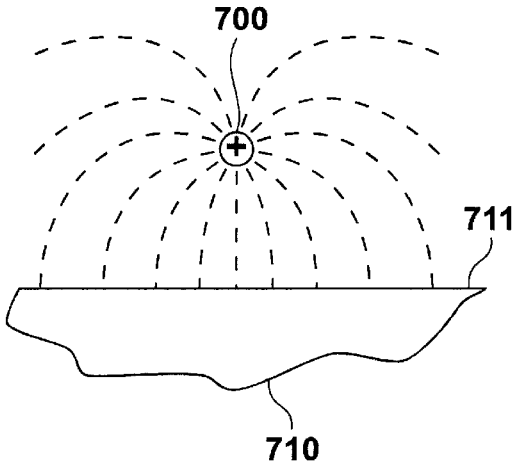
FIG. 7A shows the electric field produced by a positive charge above a conducting ground plane.
Figure 7B:
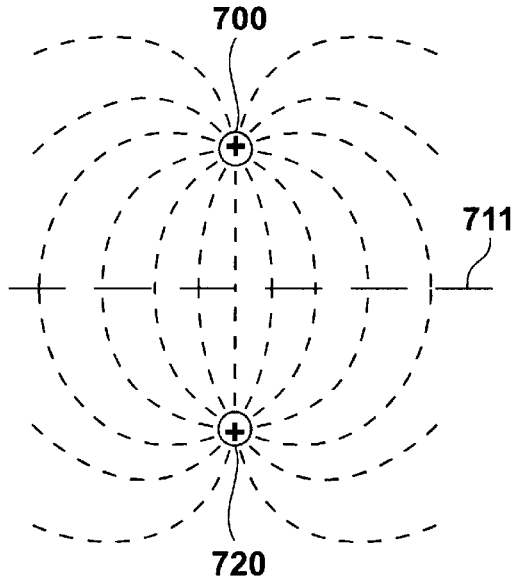
FIG. 7B shows the electric field produced by a positive charge above a surface and a negative charge below the positive charge at an equal distance from the surface.

For an actual charge distribution above a conducting plane (such as a ground plane), the conducting plane acts to produce fields equivalent to a mirror-image, but inversely-charged, image charge distribution. This is due to the fact that the electric field must be normal to the surface of a conductor. (If the electric field has a component parallel to the surface of the conductor, that component will generate currents that will produce a charge distribution that will cancel the parallel component of the electric field.) This is depicted in FIG. 7A for a positive point charge (700) above a conducting material (710) with a planar top surface (711). FIG. 7B illustrates how the same electric fields above the surface (711) are generated (without the existence of a conducting material (710)) by the positive point charge (700) in combination with a negative point charge (720) placed the same distance below the surface (711). More generally, if the ground plane (711) is located on the x-y plane (i.e., the z=0 plane) and there is a charge distribution of $\rho(x, y, z)$ above the ground plane, the fields produced in the region above the ground plane (711) by the charge distribution $\rho(x, y, z)$ in combination with the ground plane (711) are equivalent to the field that would be produced by a charge distribution of $-\rho(x, y, -z)$ in the region below the ground plane (711).

Figure 7C:
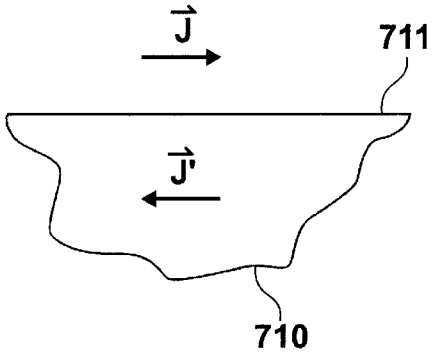
FIG. 7C shows the relationship between a horizontal current and its ground-plane image.
Figure 7D:
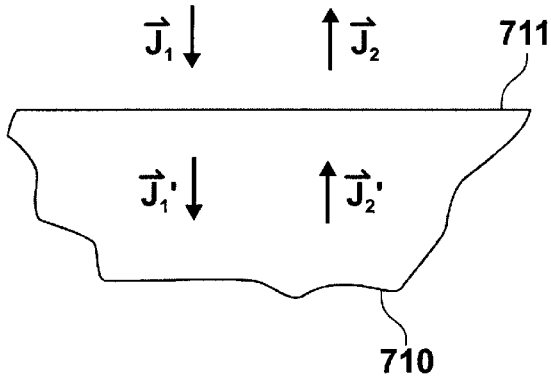
FIG. 7D shows the relationship between vertical currents and their ground-plane images.
Figure 8A:
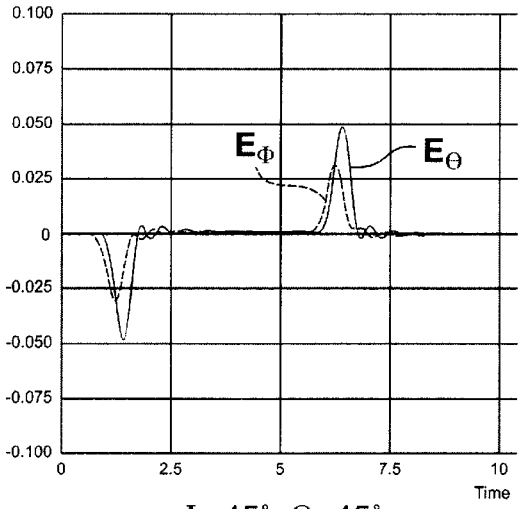
FIGS. 8A–8D are time plots of the components of the radiated electric field produced by the monopole large-current radiator of FIG. 4C in four directions.
Figure 8B:
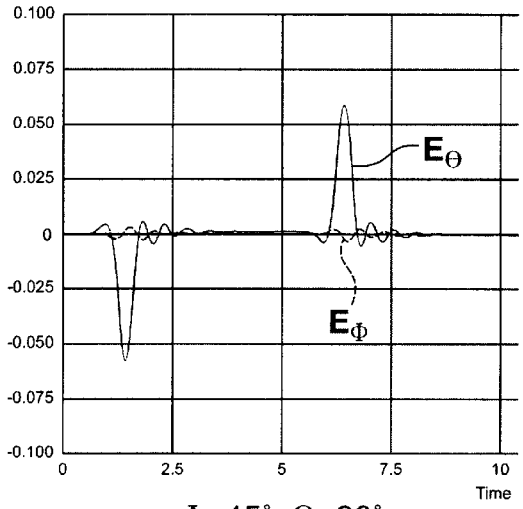
Figure 8C:
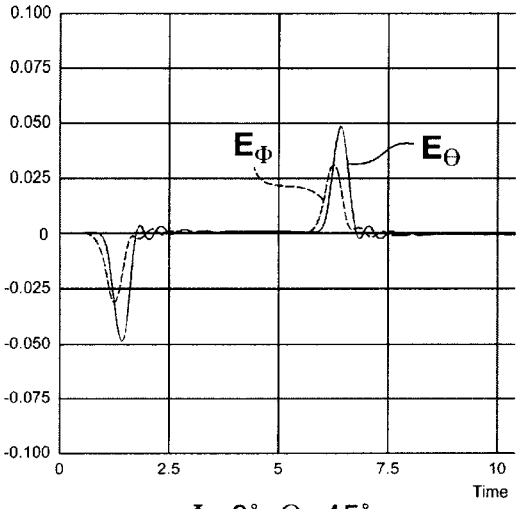
Figure 8D:
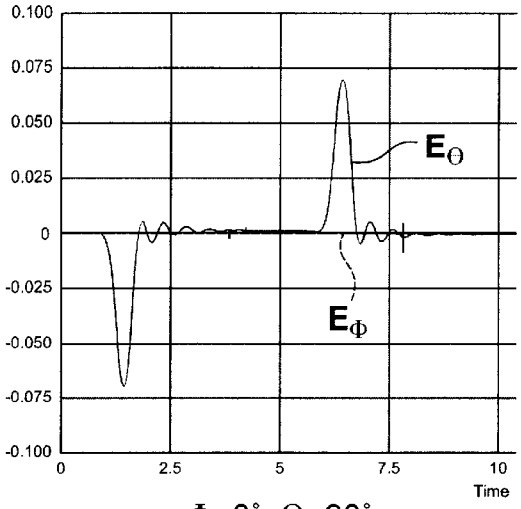

When a charge is in motion in the x-y plane, the image charge has a velocity of equal magnitude and direction (ignoring for the moment the finite velocity of electromagnetic fields). However, since current is dependent on the product of charge and velocity, the image current produced by a charge in motion in the x-y plane is of equal magnitude but opposite direction to the actual current produced by the actual charge. That is, an actual charge of value q with a velocity v in the x-y plane produces a current J=q v, and its image charge has a value −q and velocity v, resulting in a current J'=q v. Therefore, by extension, a current distribution J(x, y, z) in the x-y plane produces an image current distribution of J'=J(x, y, −z). This is depicted in FIG. 7C for a current distribution J(x, y, z) which is above the ground plane (711) and is horizontal.

However, when a charge is in motion in the z direction (i.e., the direction normal to the surface of a conductor), the image charge has a velocity of equal magnitude, but in the opposite direction (ignoring for the moment the finite velocity of electromagnetic fields). Since current is dependent on the product of charge and velocity, the image current produced by a charge in motion in the z direction is of equal magnitude and the same direction as the actual current produced by the charge. That is, an actual charge of value q with a velocity v in the z direction produces a current J=q v, and its image charge has a value −q and velocity −v, resulting in a current J'=q v. Therefore, by extension, a current distribution J(x, y, z) in the z direction produces an image current distribution of J'=J(x, y, −z). This is depicted in FIG. 7C for a downwards current $J_1(x, y, z)$ which is above the ground plane (711) and vertical, and an upwards current $J_2(x, y, z)$ which is above the ground plane (711) and vertical. (It should be noted that in the present specification and claims, a conducting material (710) which images a current distribution in accordance with the above-described current-imaging properties is referred to as a current-imaging conductor.)

This difference in the behavior of image currents of currents parallel and perpendicular to the image plane is crucial to the design of antennas according to the present invention. For instance, the combination of the main radiator (205) oriented parallel to the ground plane (210) and its ground-plane image will therefore function as a pair of parallel, oppositely-oriented dipole radiators, i.e., a quadrupole radiator. The higher the order n of an n-pole radiator, the less efficient it is. In this case, ground plane (210) acts to substantially reduce the efficiency of the antenna (200). The combination of the rear leads (220) and their ground-plane image will similarly function as a quadrupole radiator in directions away from the z direction where the main radiator (205) does not screen radiation from the rear leads (220). (Hence, the rear leads (220) are referred to as shielded leads in the claims of the present application.) Because the side leads (217) are parallel to each other and have the same size and shape, signals radiated from them (217) and their ground-plane images will fall off faster than $1/r^3$ (i.e., substantially cancel), as will the signal radiated from their images.

Figure 6B:
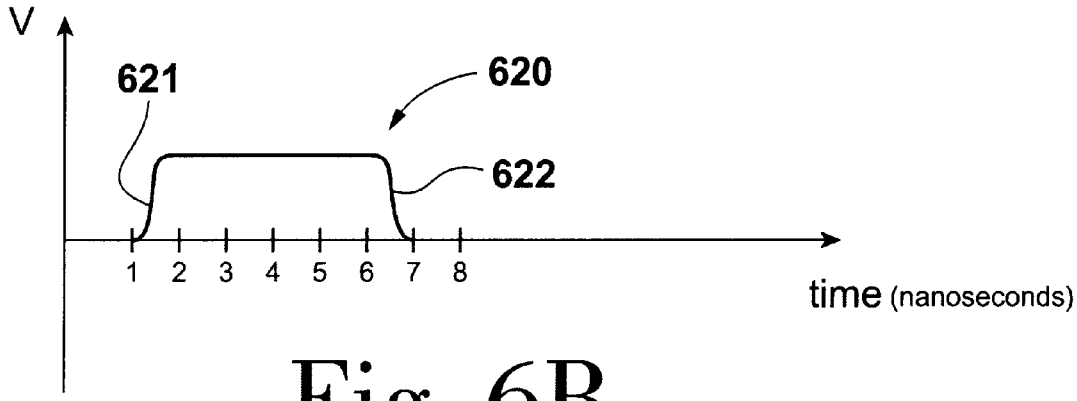
FIG. 6B shows the square pulse-like input voltage used to generate the radiation plots of FIGS. 3A–3D, 5A–5D, and 8A–8D.

The radiation at a variety of directions is shown in FIGS. 3A–3D for the dipole LCR (200) of FIG. 2 having the input signal (620) shown in FIG. 6B, which is a substantially square pulse with a rising edge (621) at 1 ns having a length of approximately 0.5 ns, and a falling edge (622) at 6 ns having a length of approximately 0.5 ns. FIGS. 3A–3D and the other radiation plots presented below were generated using the finite-difference, time-domain XFDTD™ computation package, designed by Remcom Corporation of State College, Pa., on a 1 mm×1 mm×1 mm spatial grid with a time increment of 2.0 picoseconds. It should be noted that the computations must be volumetric since currents in each volume element generate fields that affect conduction in volume elements in all directions. The conductors were assumed to have perfect conductance, and, due to the finite path length (i.e., the scattering) of electrons in a metal, the speed of the conductance was taken to be the typical value of 70% of the speed of light. (It should be noted that although these plots were generated numerically, they have been confirmed experimentally and could just as well have been generated experimentally.)

Figure 3A:
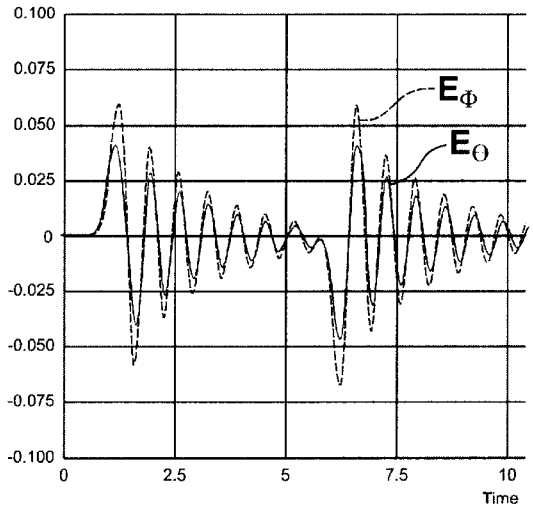
FIGS. 3A–3D are time plots of the components of the radiated electric field produced by the dipole large-current radiator of FIG. 2 in four directions.
Figure 3B:
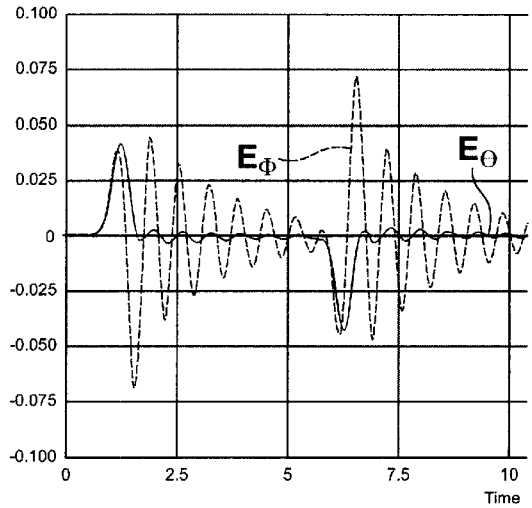
Figure 3C:
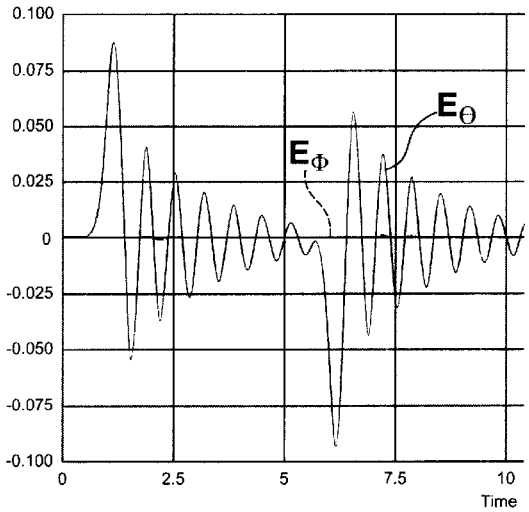
Figure 3D:
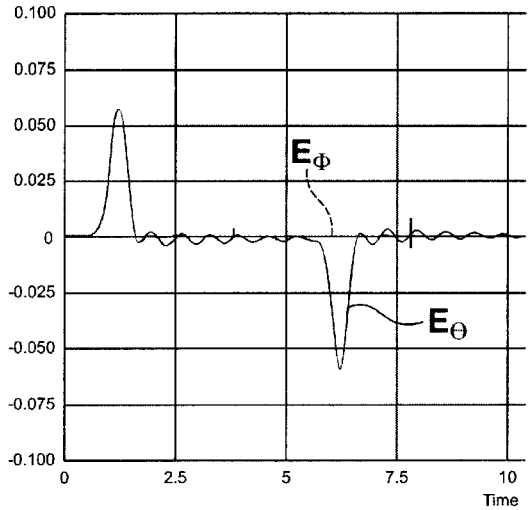

FIG. 3A shows that the Φ and Θ components of the radiated electric field, i.e., $E_\Phi$ and $E_\Theta$, at polar angle Φ=45° and azimuthal angle Θ=45° both have significant ringing (i.e., continued oscillations) after the initial peaks at 1 ns and 6 ns. In contrast, FIG. 3B shows that at Φ=45° and Θ=90°, the Φ component of the radiated electric field, $E_\Phi$, has significant ringing after the initial peaks at 1 ns and 6 ns, while the Θ component of the radiated electric field, $E_\Theta$, has considerably less ringing. FIGS. 3C and 3D show the Φ and Θ components of the radiated electric field, $E_\Phi$ and $E_\Theta$, at Φ=0° and Θ=45°, and at Φ=0° and Θ=90°, respectively, and in both cases the Φ component of the radiated electric field, $E_\Phi$, is essentially zero. It may be noted that the Θ component of the radiated electric field, $E_\Theta$, behaves in FIG. 3C much as it does in FIG. 3A, and behaves in FIG. 3D much as it does in FIG. 3B. That is, the Θ component of the radiated electric field, $E_\Theta$, is predominantly dependent on the polar angle Θ, and only weakly dependent on the azimuthal angle Φ.

For the antenna (200) of FIG. 2, the impulse response is only acceptable for the Θ component of the radiated electric field, $E_\Theta$, at Φ=0° and Θ=90°; in other directions at least one of the electric field components, $E_\Phi$ and $E_\Theta$, rings after the initial pulse. Because some of these ringing radiated signals might be reflected or diffracted into the Φ=0° and Θ=90° direction, they can even corrupt the impulse response in this direction. Thus, the overall impulse response of the DLCR (200) of FIG. 2 is poor, and the DLCR (200) is of limited usefulness.

Figure 4A:
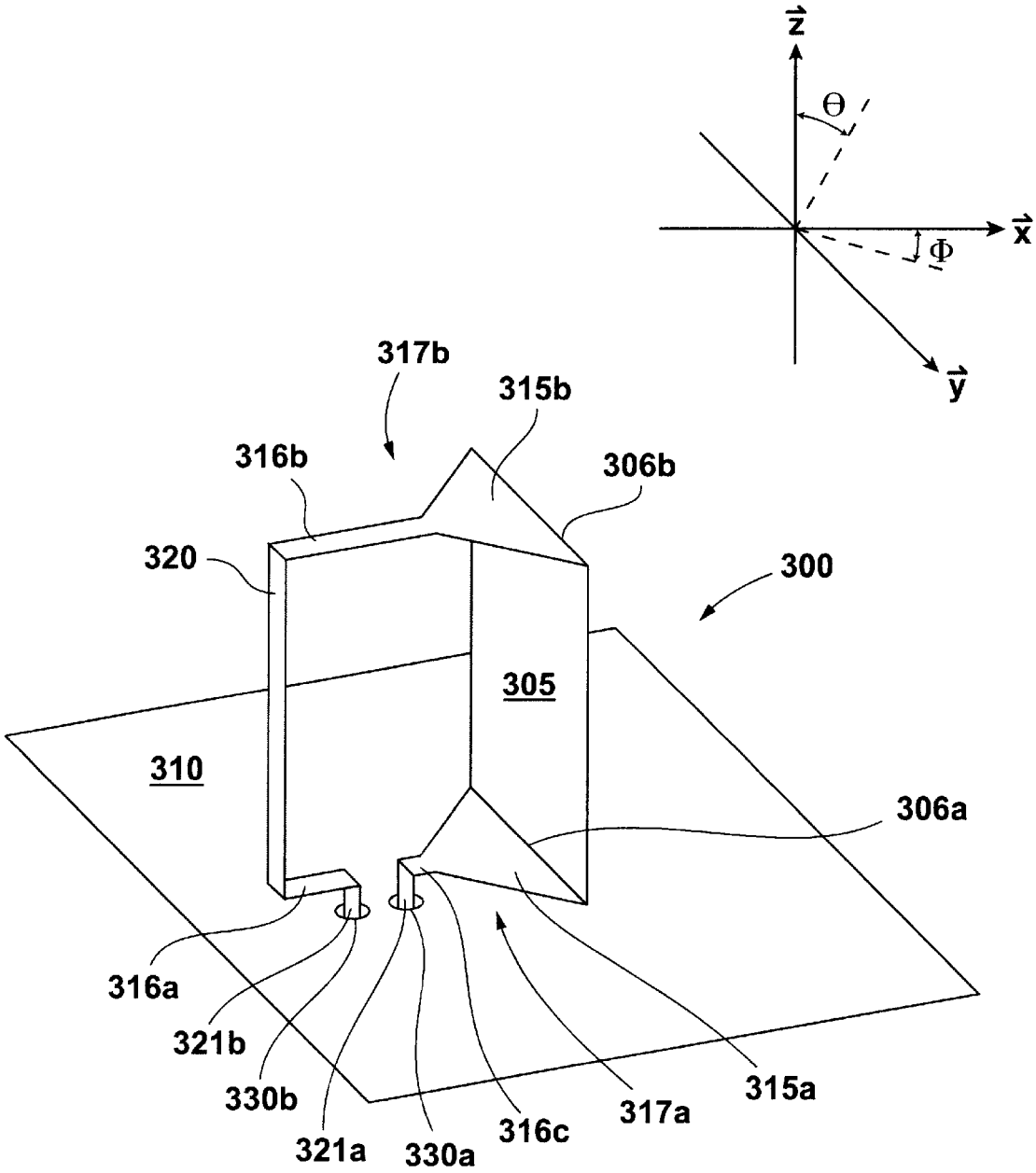
FIG. 4A shows a monopole large-current radiator according to the present invention.

A monopole large-current radiator (MLCR) (300) according to the present invention is shown in FIG. 4A. The MLCR (300) includes a horizontal ground plane (310) with a front aperture (330*a*) and a rear aperture (330*b*), a main radiator (305), a top lead (317*b*), a rear lead (320), a front bottom lead (317*a*), and a rear bottom lead (316*a*). Although its geometry is similar to that of the DCLR (200) of FIG. 2, its orientation perpendicular to the ground plane (310) produces a substantially different impulse response. The main radiator (305) is mounted vertically on the ground plane (310) with its normal vector along the +x direction, and it (305) has a height slightly greater than its width across the y direction. The top lead (317*b*) extends in the −x direction from the top end (306*b*) of the main radiator (305), and consists of a flared section (315*b*) in the front, and a top thin lead (316*b*) in the rear. The rear lead (320) extends downwards from the rear end of the top thin lead (317*b*). The front bottom lead (317*a*) extends in the −x direction from the bottom end (306*a*) of the main radiator (305), and consists of a flared section (315*a*) in the front, and a front bottom thin lead (316*c*) in the rear. The thin lead (316*c*) is connected to a vertical power lead (321*a*) at its rear end, and the power lead (321*a*) passes through the front aperture (330*a*). The rear bottom lead (316*a*) extends in the +x direction from the bottom end of the rear lead (320), and is connected at its front end to a vertical power lead (321*b*) which passes through the second aperture (330*b*). The vertical power leads (321*a*) and (321*b*) are connected to a power source (not visible) if the antenna (300) is to transmit, or a reception circuit (not visible) if the antenna (300) is to receive transmissions.

According to the present invention, the main radiator (305) has a height-to-width aspect ratio preferably between 6 and 0.33, more preferably between 3 and 0.75, and most preferably around 1.5. Furthermore, the rear radiator (320), the top thin lead (316*b*), the front bottom lead (316*c*) and the rear bottom thin lead (316*a*) are narrow but have a width just sufficient to produce a reasonably small inductance, since any inductance in the antenna will attenuate the radiation of the high frequencies required to produce narrow pulses. Furthermore, the ratio of the distance between the main radiator (305) and the rear radiator (320) to the width of the main radiator (305) is preferably between 4 and 0.25, more preferably between 3 and 0.33, more preferably between 2 and 0.5, and most preferably around 1.0. Furthermore, the aspect ratio of the ground plane (310) is preferably between 3 and 0.33, more preferably between 2 and 0.5, and most preferably around 1.0. To best simulate an infinite ground plane, edge effects are minimized by mounting the antenna (300) near the center of the ground plane (310). Furthermore, the ratio of the height of the main radiator (305) to the length or depth of the ground plane is preferably between 3 and 0.2, more preferably between 1.5 and 0.37, and most preferably around 0.75. Since the radiated power scales with size, the size of the antenna is a compromise between making the antenna large enough to be a sufficiently powerful radiator, and not making the antenna so large that it is unwieldy for its particular application. According to the preferred embodiment of the present invention, the main radiator (305) has a height of 30 mm and a width of 20 mm, the rear radiator (305) has a height of 30 mm and a width of 3 mm, the main radiator (305) is separated from the rear radiator (305) by 20 mm, and the ground plane has dimensions of 40 mm by 40 mm. The rear radiator (320), the top thin lead (316*b*), the front bottom lead (316*c*) and the rear bottom thin lead (316*a*) have a width of 3 mm. The main radiator (305), side leads (317) and (316*a*), rear radiator (320), and power leads (321) are integrally formed from thin sheet metal. The sheet metal is thin to reduce the weight of the antenna (300). However, the metal should not be so thin as to provide a structure lacking sturdiness. According to the preferred embodiment, the sheet metal has a thickness of at least 0.4 mm. According to the preferred embodiment, the thickness of the sheet metal is at least a few times the skin depth of the highest frequencies of the current. Although the borders between the planar sections (305), (317), (320), (316*a*), and (321) appear to be sharp, right-angle edges in FIG. 4A, according to the preferred embodiment, sharp edges, angles, and corners are to be avoided due to their effects on charge distributions in the antenna (300). According to the preferred embodiment, the edges between planar sections (305), (317), (320), (316*a*), and (321) are actually rounded with a radius of curvature of 2 mm. The need to avoid sharp corners is also the motivation for the flared portions (315) of the top and bottom leads (317).

According to the present invention, the antenna (300) of FIG. 4A is powered using an unbalanced power source. That is, one of the power leads (321*a*) or (321*b*) is connected to the ground plane (310), while the other power lead (321*b*) or (321*a*) is connected to the power supply (not shown). In the preferred embodiment, the power lead (321*a*) nearer the main radiator (305) is grounded. When a positive voltage is applied by the power source to the power lead (321*b*), a positive current propagates across the rear bottom lead (316*a*), up the rear lead (320), across the top lead (317*b*) from left to right, and down the main radiator (305), before propagating across the front bottom lead (317*a*) from right to left and going to the ground plane (310) via the power lead (321*a*). Because there is not an equivalent propagation upwards of a (downwards flowing) current across the main radiator (305), the antenna (300) is considered to be a monopole LCR (MLCR). However, it is important to note that (under the approximation that the ground plane (310) is infinite and therefore acts as an ideal ground plane) a downwards-flowing image current propagates upwards from the lower edge of the image of the main radiator (305) as the positive current propagates downwards from the upper edge of the actual main radiator (305). Therefore, the antenna (300) radiates with characteristics of a dipole radiator in the x direction where radiation from the rear radiator (320) is screened by the main radiator (305).

Figure 5A:
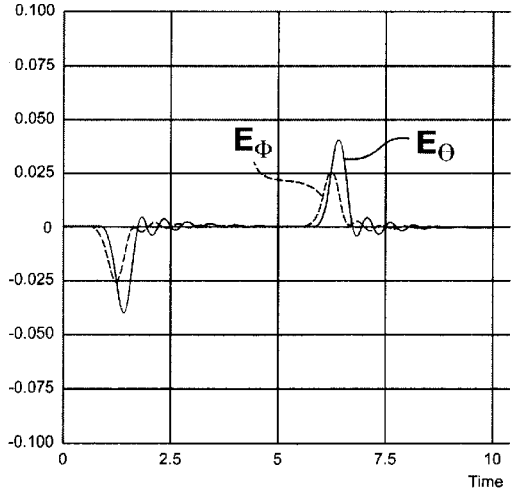
FIGS. 5A–5D are time plots of the components of the radiated electric field produced by the monopole large-current radiator of FIG. 4A in four directions.
Figure 5B:
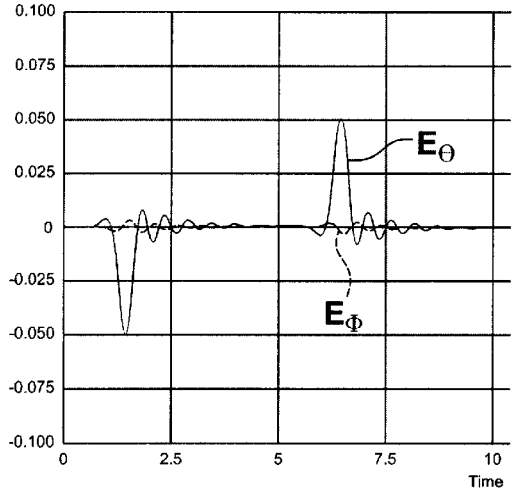
Figure 5C:
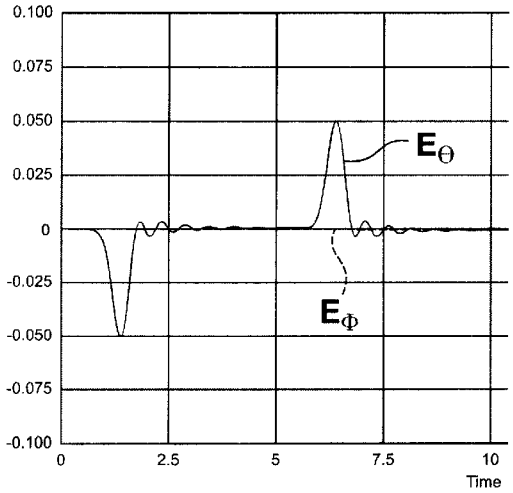
Figure 5D:
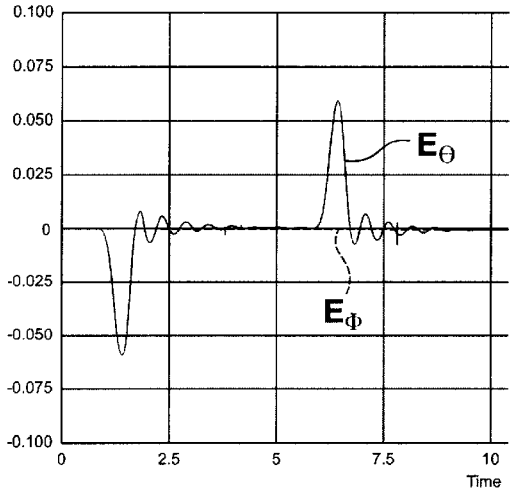

FIGS. 5A–5D plot the Φ and Θ components of the radiated electric field, i.e., $E_\Phi$ and $E_\Theta$, in four directions for the antenna (300) of FIG. 4A. As shown in FIG. 5A, the Φ and Θ components of the radiated electric field, $E_\Phi$ and $E_\Theta$, at polar angle Φ=45° and azimuthal angle Θ=45° both have substantial initial peaks at 1 ns and 6 ns, and the ringing following the initial peaks is relatively small. In the plot of FIG. 5B for radiation at polar angle Φ=45° and azimuthal angle Θ=90° it can be seen that, again, the Θ component of the radiated electric field, $E_\Theta$, has substantial initial peaks at 1 ns and 6 ns, and the ringing following the initial peaks is relatively small. However, in this direction the Φ component of the radiated electric field, $E_\Phi$, is relatively weak. FIGS. 5C and 5D plot the Φ and Θ components of the radiated electric field, $E_\Phi$ and $E_\Theta$, at Φ=0° and Θ=45°, and at Φ=0° and Θ=90°, respectively, and (as was the case with FIGS. 3C and 3D) in both cases the Φ component of the radiated electric field, $E_\Phi$, is essentially zero. However, in contrast with FIGS. 3C and 3D for the DLCR (200) of FIG. 2, FIGS. 5C and 5D show that the Θ component of the radiated electric field, $E_\Theta$, for the MLCR (300) of FIG. 4A has substantial initial peaks at 1 ns and 6 ns, and the ringing following the initial peaks is relatively small. Because the ringing from both field components, $E_\Phi$ and $E_\Theta$, in each direction is small compared to the largest radiated peak in that direction, the MLCR (300) of FIG. 4A functions effectively as an antenna for non-sinusoidal spread spectrum communications.

Figure 4B:
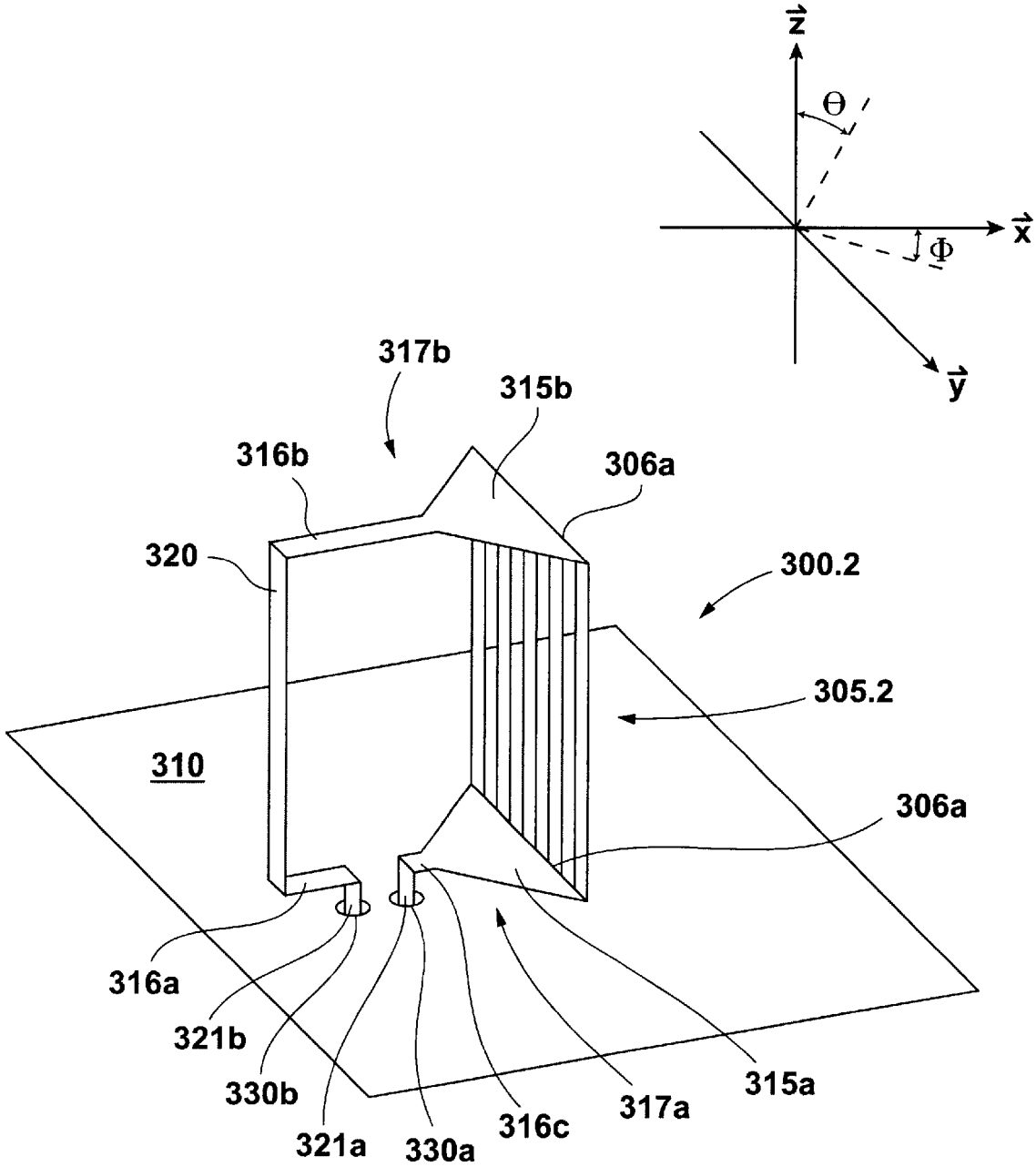
FIG. 4B shows an alternate embodiment of the monopole large-current radiator of FIG. 4A where the main radiator is a series of bars.

An alternate embodiment of a monopole large-current radiator (MLCR) according to the present invention is shown in FIG. 4B. As was the case with the MLCR (300) of FIG. 4A, the MLCR (300.2) of FIG. 4B includes a horizontal ground plane (310) with a front aperture (330*a*) and a rear aperture (330*b*), a main radiator (305.2), a top lead (317), a rear lead (320), a front bottom lead (317), and a rear bottom lead (316*a*). (Components whose geometry and orientation are the same in FIGS. 4A–4E, are assigned the same reference numerals.) The geometry of these components is essentially the same as for the corresponding components of FIG. 4A, except that the planar, main radiator (305) of FIG. 4A has been replaced with a series of parallel vertical bars (305.2), which according to the present invention are regularly spaced. The bars (305.2) may have rectangular cross-sections as shown in FIG. 4B, or may have cross-sections of other shapes, such as circles. The construction preferences discussed above in reference to the MLCR (300) of FIG. 4A also apply to the MLCR (300.2) of FIG. 4B, and preferably the bars across the width of the main radiator (305.2) are 2 mm in width and separated by 4 mm. Although it is lighter because it uses less metal, a disadvantage of the structure of the MLCR (300.2) of FIG. 4B is that it is not as mechanically rigid as the structure of the MLCR (300) of FIG. 4A.

Figure 4C:
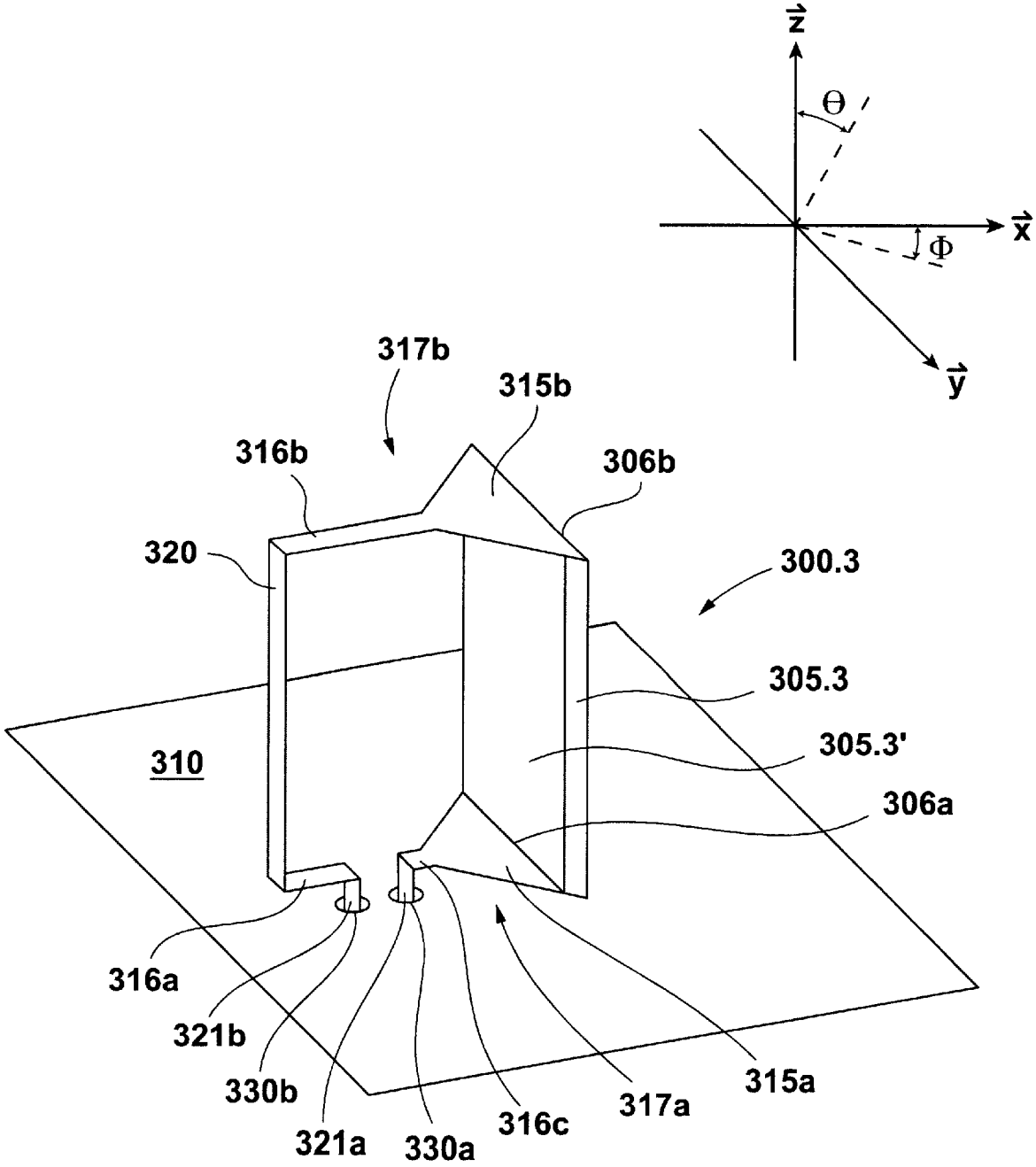
FIG. 4C shows an alternate embodiment of the monopole large-current radiator of FIG. 4A where a conducting plate is positioned behind the main radiator.

Another alternate embodiment of a monopole large-current radiator (MLCR) according to the present invention is shown in FIG. 4C. As was the case with the MLCR (300) of FIG. 4A, the MLCR (300.3) of FIG. 4C includes a horizontal ground plane (310) with a front aperture (330*a*) and a rear aperture (330*b*), a main radiator (305.3), a top lead (317), a rear lead (320), a front bottom lead (317), and a rear bottom lead (316*a*). The geometry of these components is the same as for the corresponding components of FIG. 4A, except that an additional, planar, screening sheet (305.3') having essentially the same dimensions as the main radiator (305.3) is located near and directly behind the main radiator (305.3). As with the main radiator (305.3), the screening sheet (305.3') electrically spans the flared portions (315) of the top and bottom leads (317). The construction preferences discussed above in reference to the MLCR (300) of FIG. 4A also apply to the MLCR (300.3) of FIG. 4C. The advantage produced by the screening sheet (305.3') is that it provides additional screening in the x direction for radiation from the rear lead (320), thereby producing less interference with the current flow in the main radiator (305). FIGS. 8A–8D plot the $\Phi$ and $\Theta$ components of the radiated electric field, i.e., $E_\Phi$ and $E_\Theta$, in four directions for the antenna (300.3) of FIG. 4C. As can be seen by a comparison of the plots of FIGS. 5A–5D and 8A–8D, the radiation characteristics are essentially the same except for the difference that for $\Phi=0°$ and $\Theta=45°$, $\Phi$ component of the radiated electric field, $E_\Phi$, is not zero, and in fact has a well-formed initial peak with very little ringing. Therefore, the MLCR (300.3) of FIG. 4C is superior to the MLCR (300) of FIG. 4A.

Figure 4D:
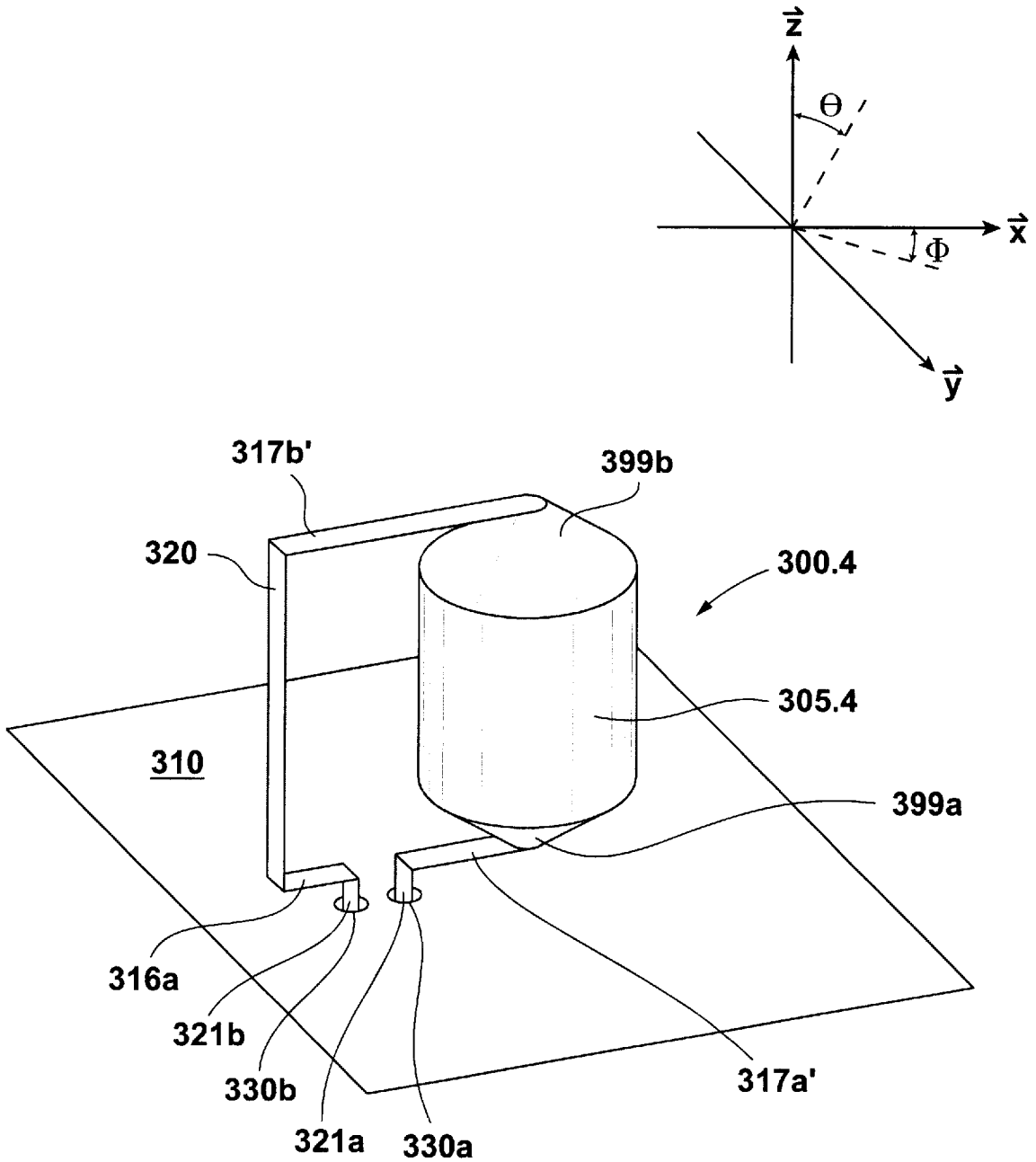
FIG. 4D shows an alternate embodiment of the monopole large-current radiator of FIG. 4A where a conducting cylinder is substituted for the planar, main radiator.

Another alternate embodiment of a monopole large-current radiator (MLCR) according to the present invention which functions in a manner similar to the MLCR (300.3) of FIG. 4C is shown in FIG. 4D. As was the case with the MLCR (300) of FIG. 4A, the MLCR (300.4) of FIG. 4D includes a horizontal ground plane (310) with a front aperture (330*a*) and a rear aperture (330*b*), a main radiator (305.3), a top lead (317), a rear lead (320), a front bottom lead (317), and a rear bottom lead (316*a*). The geometry of these components is the same as for the corresponding components of FIG. 4A, except that a cylindrical conductor (305.4) is substituted for the planar conductor (305) of FIG. 4A, and the top lead (317*b*') and the front bottom lead (317*a*') do not have a flaired section. Rather, the cylindrical conductor (305.4) has conical end sections (399) with a height of roughly 5 mm to avoid the effects produced by sharp edges discussed above. The construction preferences discussed above in reference to the MLCR (300) of FIG. 4A also apply to the MLCR (300.3) of FIG. 4D with the relations for the width of the main radiator (305) in FIG. 4A applying to the diameter of the cylinder (305.4) of FIG. 4D. In this embodiment, the advantages of the screening sheet (305.3') of the MLCR (300.3) of FIG. 4C are provided by the rear surface of the cylindrical conductor (305.4). That is, the cylindrical conductor (305.4) provides additional screening in the x direction for radiation from the rear lead (320), thereby producing less interference with the current flow in the main radiator (305) and providing radiation characteristics more nearly approximating that of a pure monopole. The radiation characteristics for the MLCR (300.4) of FIG. 4D are essentially the same as those shown in FIGS. 8A–8D. Therefore, the MLCR (300.4) of FIG. 4D is superior to the MLCR (300) of FIG. 4A. However, it should be noted that the size of MLCR (300.4) of FIG. 4D is larger than the size of the MLCR (300.3) of FIG. 4C. If a transceiver uses two antennas, one for transmissions and one for receptions, the MLCRs (300.4) of FIG. 4D cannot be oriented to avoid blocking each other's operation, as could be the case with the MLCRS (300), (300.2) or (300.3) of FIGS. 4A, 4B or 4C.

Figure 4E:
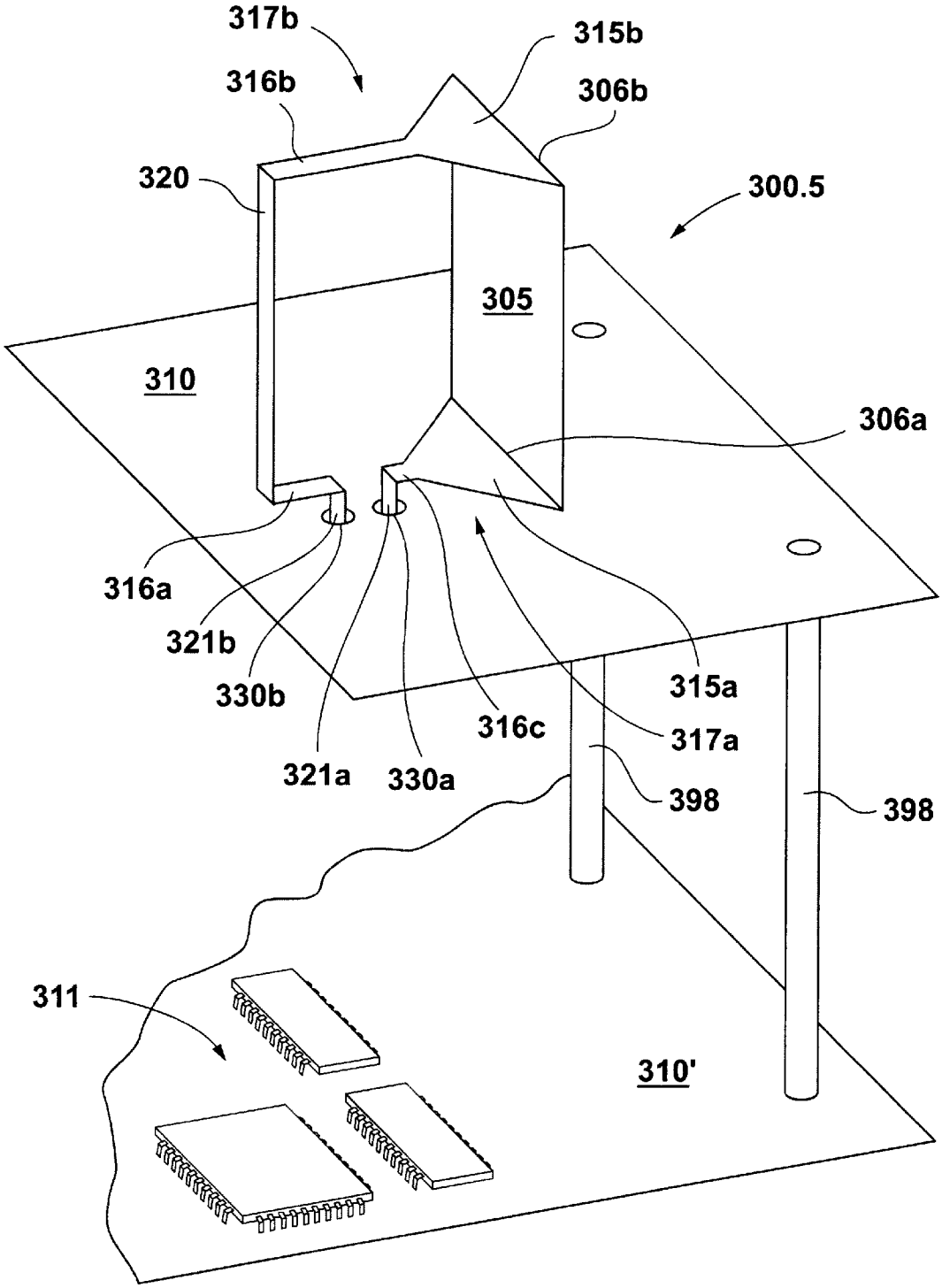
FIG. 4E shows an alternate embodiment of the monopole large-current radiator of FIG. 4A with two ground planes.

Another alternate embodiment of a monopole large-current radiator (MLCR) according to the present invention is shown in FIG. 4E. As was the case with the MLCR (300) of FIG. 4A, the MLCR (300.5) of FIG. 4E includes a horizontal ground plane (310) with a front aperture (330*a*) and a rear aperture (330*b*), a main radiator (305.3), a top lead (317), a rear lead (320), a front bottom lead (317), and a rear bottom lead (316*a*). The geometry of these components is the same as for the corresponding components of FIG. 4A, and the construction preferences discussed above in reference to the MLCR (300) of FIG. 4A also apply to the MLCR (300.5) of FIG. 4E. However, the MLCR (300.5) of FIG. 4E differs from the MLCR (300) of FIG. 4A in that there is a second ground plane (310') below the first ground plane (310) and parallel to it. The second ground plane (310') bears the circuitry (311) for the transceiver. The circuitry (311) may be transmission circuitry, reception circuitry, or both. (It should be understood that although FIG. 4E explicitly depicts transceiver circuitry, transmission circuitry and/or reception circuitry may be mounted on the ground planes 210 and 310 shown in the other figures aw well.) The two ground planes (310) and (310') are electrically coupled by one or more struts (398) having an inductance on the order of microhenries to prevent high-frequency current flows between the ground planes (310) and (310'). An advantage of the MLCR (300.5) of FIG. 4E over the MLCR (300) of FIG. 4A is that the distance and electrical impedance will have the effect that transmissions from the MLCR (300.5) will tend to interfere less with the circuitry (311), and emissions from the circuitry (311) will tend to interfere less with receptions. The radiation characteristics for this MLCR (300.5) are essentially the same as the radiation characteristics depicted in FIGS. 5A–5D.

Thus, it will be seen that the improvements presented herein are consistent with the objects of the invention for an antenna described above. While the above description contains many specificities, these should not be construed as limitations on the scope of the invention, but rather as exemplifications of preferred embodiments thereof. Many other variations are within the scope of the present invention. For instance: the main radiator may have a variety of shapes, such as a planar circle, planar triangle, planar diamond, sphere, cone, pyramid, parallepiped, etc.; the main radiator may have an aspect ratio outside the ranges described; the rear lead (i.e., the shielded radiator) may be taller or shorter than the main radiator; the rear lead, top lead and bottom leads may have other cross-sectional shapes, such as square, circular, triangular, etc.; the grounding conductor need not be rectangular; the grounding conductor (i.e., the current-imaging conductor) need not have a planar upper surface; the top and bottom leads may be flared via other shapes, or may not be flared at all; the ratio of the width, or height, of the main radiator to the distance to the rear lead may have other values; in the embodiment with the main radiator with bars, the bars need not be parallel, of equal width, or regularly spaced; the power source need not be unbalanced; the power source may be a voltage or a current source; one of the leads to the antenna need not be grounded; the impedance of the rear lead, top and bottom leads and/or main radiator may not be low over one or more frequency ranges; the rounding at joints between the rear lead, top lead, the bottom leads and the main radiator may a radius of curvature other than that described; the antenna may be used for transmissions and/or receptions over a narrower frequency range, or a variety of narrower frequency ranges; the antenna may be used for transmissions and/or receptions of pseudonoise signals which do not consist of series of pulses; the antenna may be used for transmissions and/or receptions over a narrow solid angle; the antenna may incorporate a radiation absorber; etc. Accordingly, it is intended that the scope of the invention be defined by the claims appended hereto and their equivalents.

What is claimed is:

1. A wideband electromagnetic radiation antenna comprising:

a current-imaging conductor having a substantially planar upper surface section;

an electrically conducting main radiator mounted above said upper surface section of said current-imaging conductor, said main radiator having a front surface, a rear surface, a main-radiator upper edge and a main-radiator lower edge, said front surface having a front-surface width and a front-surface height from about said main-radiator upper edge to about said main-radiator lower edge, and said front surface being substantially perpendicular to said upper surface section of said current-imaging conductor;

an electrically conducting shielded radiator mounted above said upper surface section of said current-imaging conductor and located a separation distance behind said main radiator, said shielded radiator having a shielded-radiator upper edge, a shielded-radiator lower edge, a shielded-radiator width, and a shielded-radiator height from about said shielded-radiator upper edge to about said shielded-radiator lower edge, said shielded-radiator width being substantially smaller than said front surface width; and an electrically conducting upper lead having an upper-lead rear edge connecting to said shielded-radiator upper edge and an upper-lead front edge connecting to said main-radiator upper edge, said upper lead spanning from about said main-radiator upper edge of said main radiator to about said shielded-radiator upper edge of said shielded-radiator.

2. The wideband electromagnetic radiation antenna of claim 1 wherein said shielded-radiator height is substantially equal to said main-radiator height.

3. The wideband electromagnetic radiation antenna of claim 2 wherein said upper lead has a first width near the shielded radiator, and a second width near the main radiator, the first width being roughly said shielded-radiator width, and said second width being roughly said main-radiator width.

4. The wideband electromagnetic radiation antenna of claim 3 wherein a first ratio of said front-surface height to said front-surface width of said main radiator is roughly 1.5.

5. The wideband electromagnetic radiation antenna of claim 4 wherein a second ratio of said separation distance between said main radiator and said shielded radiator to said main-radiator width is roughly unity.

6. The wideband electromagnetic radiation antenna of claim 1 wherein said upper surface section of said current-imaging conductor has an aspect ratio of roughly unity.

7. The wideband electromagnetic radiation antenna of claim 6 wherein said main radiator is located roughly near the center of said upper surface section of said current-imaging conductor.

8. The wideband electromagnetic radiation antenna of claim 1 wherein the electrical impedance between said shielded-radiator lower edge and said main-radiator lower edge, defined by an electrical path up said shielded radiator from said shielded-radiator lower edge to said shielded-radiator upper edge, across said upper lead from said upper-lead rear edge to said upper-lead front edge, and down said main radiator from said main-radiator upper edge to said main-radiator lower edge, is low.

9. The wideband electromagnetic radiation antenna of claim 8 wherein the electrical impedance is low for frequencies on the order of a gigahertz.

10. The wideband electromagnetic radiation antenna of claim 9 wherein said main radiator, said shielded radiator and said upper lead are low impedance conductors having thicknesses of at least a few times the skin depth at gigahertz frequencies.

11. The wideband electromagnetic radiation antenna of claim 1 wherein connecting edges between said shielded radiator, said upper lead, and said main radiator have a radius of curvature of at least 2 mm.

12. The wideband electromagnetic radiation antenna of claim 1 further including a power source electrically spanning from about said shielded-radiator lower edge of said shielded radiator to about said main-radiator lower edge of said main radiator.

13. The wideband electromagnetic radiation antenna of claim 12 wherein currents produced by said power source generate wideband electromagnetic radiation from the wideband electromagnetic radiation antenna.

14. The wideband electromagnetic radiation antenna of claim 13 wherein said wideband electromagnetic radiation is ultra-wideband electromagnetic radiation.

15. The wideband electromagnetic radiation antenna of claim 14 wherein said power source generates a step function in voltage with a ramp time on the order of nanoseconds or less.

16. The wideband electromagnetic radiation antenna of claim 13 wherein said current-imaging conductor acts as a first ground for said power source.

17. The wideband electromagnetic radiation antenna of claim 16 wherein said power source is an unbalanced power source.

18. The wideband electromagnetic radiation antenna of claim 17 wherein a first lead from said unbalanced power source is electrically connected to said current-imaging conductor so that said first lead is grounded to said first ground.

19. The wideband electromagnetic radiation antenna of claim 18 wherein there is an electrical connection from about said main-radiator lower edge to said current-imaging conductor so that said main-radiator lower edge is grounded to said first ground, and said shielded-radiator lower edge is electrically insulated from said current-imaging conductor and electrically connected to a second lead from said unbalanced power source.

20. The wideband electromagnetic radiation antenna of claim 19 further including a second ground for signal processing circuitry for the wideband electromagnetic radiation antenna, said second ground being electrically coupled to said first ground by an electrical coupler having an inductance on the order of tens of millihenries.

21. The wideband electromagnetic radiation antenna of claim 1 wherein said main-radiator is a planar sheet.

22. The wideband electromagnetic radiation antenna of claim 21 wherein said planar sheet is substantially rectangular.

23. The wideband electromagnetic radiation antenna of claim 21 further including an electrically conducting screening sheet mounted above said upper surface section of said current-imaging conductor and behind said main radiator, said screening sheet having substantially the same shape, size and orientation as said main radiator.

24. The wideband electromagnetic radiation antenna of claim 23 wherein said screening sheet is mounted substantially closer to said main radiator than said shielded radiator.

25. The wideband electromagnetic radiation antenna of claim 1 wherein said main-radiator includes a plurality of parallel, vertically-oriented bars with insulating gaps between said vertically-oriented bars.

26. The wideband electromagnetic radiation antenna of claim 25 wherein said vertically-oriented bars have widths roughly equal to said gaps between said vertically-oriented bars.

27. The wideband electromagnetic radiation antenna of claim 1 wherein said main radiator includes a substantially cylindrical section with a vertically-oriented axis of cylindrical symmetry.

28. The wideband electromagnetic radiation antenna of claim 27 wherein a substantial portion of said main radiator is said cylindrical section.

29. The wideband electromagnetic radiation antenna of claim 1 further including a reception circuit electrically spanning from about said shielded-radiator lower edge of said shielded radiator to about said main-radiator lower edge of said main radiator.

* * * * *

UNITED STATES PATENT AND TRADEMARK OFFICE

CERTIFICATE OF CORRECTION

PATENT NO. : 6,650,302 B2
DATED : November 18, 2003
INVENTOR(S) : Mohamed Said Sanad It is certified that error appears in the above-identified patent and that said Letters Patent is hereby corrected as shown below:

Column 1,
Line 4, include the following text as the first paragraph of the specification:

--Government License Rights

This invention was made with Government support under Contract/Grant N00014-00-C-0367 awarded by the Department of the Navy. The Government has certain rights in the invention. --

Signed and Sealed this

Twelfth Day of October, 2004

JON W. DUDAS
*Director of the United States Patent and Trademark Office*